United States Patent [19]

Lane

[11] Patent Number: 4,607,999

[45] Date of Patent: Aug. 26, 1986

[54] DE-WATERING PUMP

[76] Inventor: William C. Lane, Star Route Box 750, Aberdeen, Wash. 98520

[21] Appl. No.: 387,769

[22] Filed: Jun. 14, 1982

[51] Int. Cl.[4] ..... F04F 1/06; F04F 3/00

[52] U.S. Cl. ..... 417/118

[58] Field of Search ..... 417/108, 118, 360, 121

[56] References Cited

U.S. PATENT DOCUMENTS

| | | | |
|---|---|---|---|
| 3,764,235 | 10/1973 | Bitterman | 417/118 |
| 3,907,463 | 9/1975 | Eller et al. | 417/360 |
| 4,152,097 | 5/1979 | Woodard | 417/360 |

FOREIGN PATENT DOCUMENTS 2311981 12/1976 France .

*Primary Examiner*—William R. Cline
*Assistant Examiner*—John J. McGlew, Jr.
*Attorney, Agent, or Firm*—Kenneth S. Kessler

[57] ABSTRACT

A de-watering pump is designed for eliminating liquids in small diameter holes. An expandable air sack is designed such that the outer walls of the air sack can expand to interface with the inner walls of the hole which is to be de-watered. Pressurized air is forced into the hole. The pressurized sack prevents the escape of air up through the hole and directs the pressurized air and water from the hole out through the escape line.

2 Claims, 5 Drawing Figures

FIG. 1
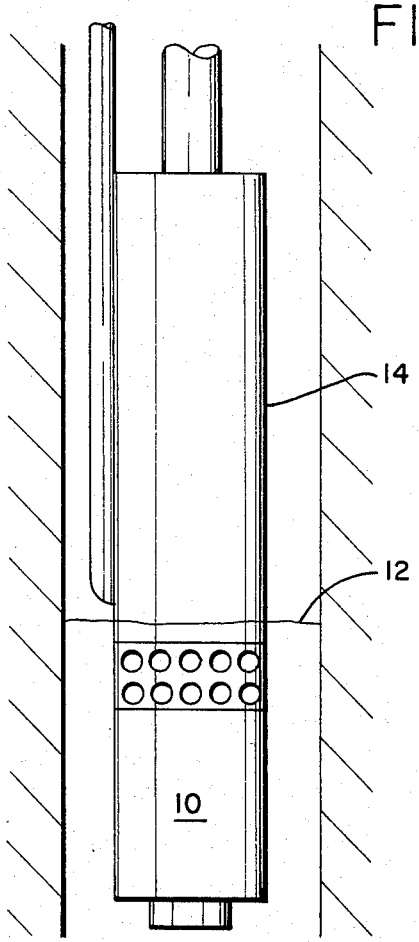
FIG. 3
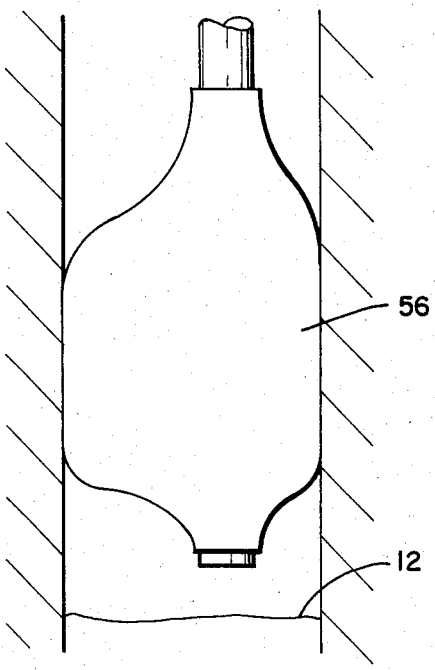
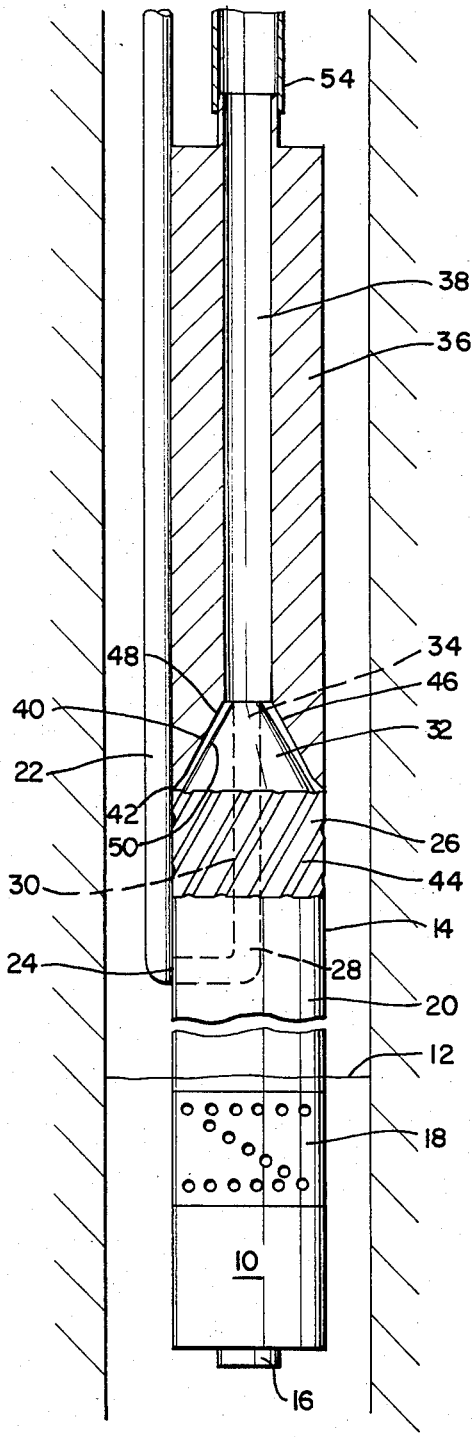
FIG. 2

DE-WATERING PUMP

SUMMARY OF THE INVENTION

The de-watering pumps set forth herein is capable of using an exhaust line and one air line in combination to de-water a hole.

In the second configuration, An expandable sack is utilized to block water from moving up the hole except through an exhaust line which is exposed to the pressurized water and air in the bottom of the hole. The operator as a single individual may solely move and maneuver the pump.

BACKGROUND OF THE INVENTION

In quarry blasting there is a definite need for the de-watering of holes. When the holes remain wet, a larger amount of explosive is necessary than when the hole is dry. The dampening of the explosive significantly reduces the effectiveness of the explosive.

In light of the above, a number of de-watering patents have been forwarded. In U.S. Pat. No. 3,764,235 a pneumatic pump for the removal of water is illustrated. The pump utilizes holes including an inflatable cylindrical hollow body of an elastic material sealed off on both ends by sealing elements.

In U.S. Pat. No. 1,765,085 a pumping device is illustrated. A cylindrical piston introduces pressure which pushes water out escape lines.

The devices presently utilized in the industry use a series of hydraulic lines and motors to de-water the holes. Lines filled with liquid are heavy and difficult to maneuver. Due to the weight of the combined lines and motors, maneuvering the pumps presently in use is a two man job.

In the present invention, since only an air line and an exit line are used in combination with an expandable sack, one man is capable of maneuvering the invention.

BRIEF DESCRIPTION OF DRAWINGS

FIG. 1 is a perspective view of the de-watering pump.

FIG. 2 is a side cut-away view of the de-watering pump.

FIG. 3 is a perspective view of the de-watering pump which utilizes an expandable air sack.

DETAILED DESCRIPTION OF THE DRAWINGS

Figure 4:
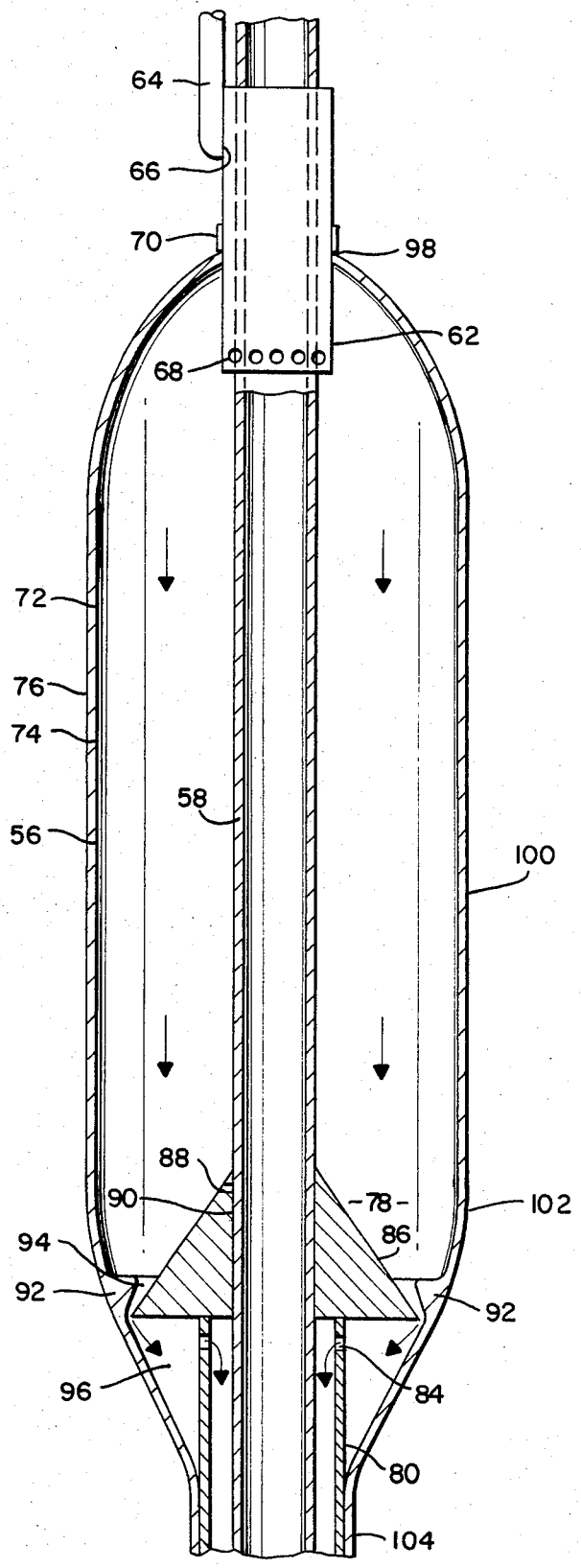
FIG. 4 is a side cut-away view of the de-watering pump which utilizes an expandable air sack.
Figure 5:
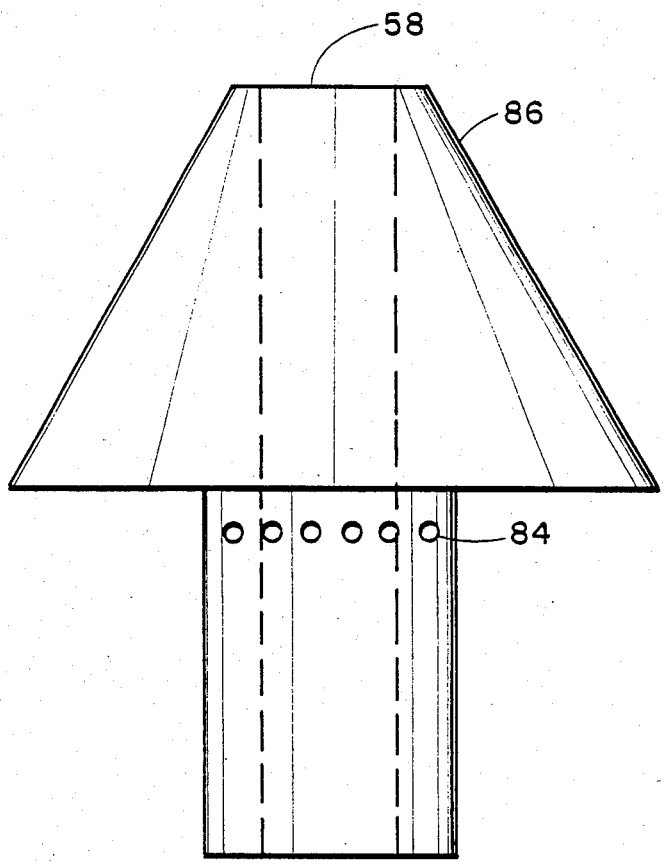
FIG. 5 is a side view of the air pressure directional insert.

In certain pourous rock formations is not effective because the water merely pours into the rock formation. After the pump is pulled from the hole, the water merely returns to its previous position.

The de-watering pump 56 as illustrated in FIG. 3 includes exhaust line 58. The exhaust line 58 runs from beneath the water line to a point where it interfaces with exit hose 60. Surrounding inner line 58 is air sleeve 62. Air passage line 64 empties into air sleeve 62 through air port 66. At the base of air sleeve 62 are escape ports 68 from which spill pressurized air.

Positioned above the escape ports 68 is the top sealing ring 70 of the expandable air sack 72.

The expandable air sack 72 is designed such that the outer wall 74 of the air sack 72 can expand to interface with the inner walls 76 of the hole thereby preventing the escape of any air or water into the porous rock formations.

At the opposing end of the expandable air sack 72 is air pressure directional insert 78. Air pressure directional insert 78 is illustrated in FIG. 4. The lower portion of the insert is cylindrical with an open bore 82. At the upper end of the cylinder 80 are ports 84.

Affixed atop the cylinder 80 is cone 86. The diameter of the cone is slightly wider than the cylinder 80. The cone tapers until it meets the bore 88 which passes through the cone 86. The bore 88 which passes through the cone 86 is of slightly smaller diameter than the open bore 82. Further, the bore 88 is of the same diameter as inner line 58. Since the open bore 82 of the cylinder 80 is of a greater diameter than the inner line 58, a space 90 is developed around the inner line 58.

A step by step analysis of the de-watering pump 56 will now be forwarded.

The expandable air sack 72, is fitted over air sleeve 62 at one end and over the air pressure directional insert 78 at the other end. This is accomplished, by inserting the air pressure directional insert over the inner line 58 and then pulling the air sack to a position above the air escape ports 68 of the air sleeve 62. Once the expandable air sack is affixed, the de-watering pump 56 is lowered into the hole upon which it is to work.

After the de-watering pump 56 is in position, pressured air is pushed through the air passage line 64 which empties into air sleeve 62 through air port 66. Once the air is in the air sleeve 62, the pressured air surges through escape ports 68 and expands the expandable air sack 72 until the outer walls of the expandable air sack 72 abut the inner walls of the hole that is being dewatered and the outer walls of the expandable sack assume the same contour as the inner walls of the hole. As the expandable sack initially expands, negligible air is able to escape beyond the bottom of the cone, for indent 92, of the expandable air sack 72 forms a tight seal which rings around the bottom of the cone 86. However, as the sack expands, a passageway 94 is formed between the indent 92 and the cone 86 and air is able to flow through passageway 94 which in turn expands the walls of the expandable air sack, and forms air chamber 96. Once air chamber 96 is formed, air surges through air ports 84 of cylinder 80, and proceeds down space 90.

With pressurized air surging towards the water line, the water is forced upward through the exhaust line 58. The water which comes into contact with the outer wall of the expandable sack, can go no further. Water, however, can escape through the exhaust line 58, thereby clearing out the water in the hole in question.

For the proper expansion of the expandable air sack 72, the sack utilizes varying wall strengths in order to control expansion. At the upper end of the expandable air sack 72 is upper wall 98. The upper wall 98 has sufficient strength to prevent any expansion of the upper wall 98 and also prevents the escape of any air as the upper wall 98 clamps on to the exhaust line 58.

Beneath the upper wall 98 is the expandable mid-section 100. The expandable mid-section 100 of the sack 72 is capable of being expanded to abut the inner walls of the hole into which the sack has been thrust.

Beneath the mid section 100 is the side wall section 102. The side wall section 102 can be expanded but is more difficult to expand than the mid-section 103 and thus, does not expand until mid section 103 has reached its full expansion.

Beneath the mid-section 102 of the expandable sack 72 is lower clasping wall 104. However, the clasping wall 104 is of sufficient strength to prevent the escape of air between the lower clasping wall 104 and the cylinder 80.

As the mid section 102 of the expandable sack 72 expands, the expansion is not only towards the inner wall of the hole, but the sack itself expands in a plane parallel to the inner exhaust line 58. In order to provide for this expansion, the bore 88 which passes through the cone 86 is designed to allow slight movement of the cone 86 and cylinder 80. Thus, as the mid section 102 expands, the cone and cylinder slide down the exhaust line 58.

Further, a small amount of air is able to escape between the bore 88 and the inner walls of the cone 86. When the pressure is being pumped into the expandable sack, the amount of air escape is negligible.

However, when the air pressure is released, and the expandable sack 72 wishes to retract, enough air can escape between the bore 88 and inner walls of the cone 86 to allow for the deflation of the expandable air sack. The allowance for this deflation thus, provides a method for the collapse of the sack and further allows the operator to pull the de-watering pump 56 from the hole. If there was no method of escape of the air from the inflated pump, the inflated pump would continue to be lodged against the inner walls 76 of the hole thereby preventing the operator to pull the pump free. Further, the escape prevents excess pressure being built up and a result such as ripping of the upper wall 98.

Although a particular embodiment of the invention has been disclosed above for illustrative purposes, it will be understood that variations or modifications thereof which are within the scope of the appended claims are contemplated. Embodiments of the inventions in which an exclusive property or privilege is claimed are defined as follows:

I claim:

1. A pump for the driving of liquid from a hole comprising:

A line;

An expandable sack surrounding said line;

A means of introducing air pressure into said expandable sack;

A conical member with a bore therethrough, said bore being of the same diameter as the diameter of said line, and said conical member positioned at a point within the expandable sack;

A hollow cylinder affixed to the bottom of said cone and of slightly larger diameter than the line, said hollow cylinder having ports therethrough and said hollow cylinder securely being affixed to the bottom of said expandable sack;

A means of preventing air pressure flow through the ports of the hollow cylinder until the expandable sack has expanded to meet the contour of the inner walls of the hole from which liquid is being pumped.

2. The pump of claim 1 wherein the means for preventing air pressure flow through the ports of the hollow cylinder comprise:

An indent from the wall of the expandable sack, said indent completely surrounding the base of said cone when the sack is not fully expanded, but said indent being sufficiently small when the sack is expanded to allow for the passage of air to the ports of the hollow cylinder affixed to the bottom of said cone.

* * * * *